United States Patent [19]

Takashi

[11] Patent Number: 4,926,660

[45] Date of Patent: May 22, 1990

[54] METHOD OF KNITTING JACQUARD KNIT FABRIC BY CIRCULAR KNITTING MACHINE

[75] Inventor: Yamaoko Takashi, Hyogo, Japan

[73] Assignee: Precision Fukuhara Works, Ltd., Hyogo, Japan

[21] Appl. No.: 254,849

[22] Filed: Oct. 7, 1988

[30] Foreign Application Priority Data

Mar. 29, 1988 [JP] Japan ..... 63-77443

[51] Int. Cl.[5] ..... D04B 9/12

[52] U.S. Cl. ..... 66/9 R; 66/93; 66/107

[58] Field of Search ..... 66/9 R, 93, 107

[56] References Cited

U.S. PATENT DOCUMENTS

| | | | |
|---|---|---|---|
| 2,715,824 | 8/1955 | Krauss et al. | 66/93 |
| 4,612,784 | 9/1986 | Plath | 66/9 R |
| 4,633,683 | 1/1987 | Schmidt | 66/9 R |

*Primary Examiner*—Wm. Carter Reynolds

*Attorney, Agent, or Firm*—Bell, Seltzer, Park & Gibson

[57] ABSTRACT

The methods of knitting the pile jacquard fabric are carried out on a circular knitting machine including needles and sinkers, and a plurality of adjacent yarn feeders. The fabric includes successive courses of plain jersey stitch wales knit of a ground yarn with each successive course also including a first pile loop yarn knit with the ground yarn in selected groups of adjacent wales and forming an individual pile loop in each intervening sinker wale, and a second pile loop yarn knit with the ground yarn in other groups of adjacent needle wales and forming an individual pile loop in each intervening sinker wale. Both the individual pile loops of the first and second pile loop yarns are positioned in side-by-side relationship in adjacent groups in each successive continuous ground yarn course so that the density of the pile loops corresponds with the density of the ground yarn stitch loops. The upstanding individual pile loops are adapted to be cut in a shearing operation to form a patterned velour jacquard fabric.

1 Claim, 6 Drawing Sheets

METHOD OF KNITTING JACQUARD KNIT FABRIC BY CIRCULAR KNITTING MACHINE

FIELD OF THE INVENTION

This invention relates generally to methods of knitting pile jacquard fabric on a circular knitting machine, and more particularly to methods of knitting such fabric which involve feeding the ground and pile yarns while selectively operating the needles and sinkers to selectively form pile loops of different pile loop yarns in adjacent groups of sinker wales in side-by-side relationship in each course to provide a dense velour type jacquard pattern fabric after the loops are cut in the finishing process.

BACKGROUND OF THE INVENTION

It is generally known to provide a pile loop jacquard pattern fabric on a circular knitting machine by utilizing sinker pattern wheels for knitting this type of pile jacquard fabric. This known method of knitting a pile loop jacquard fabric is illustrated in FIGS. 29–31. As shown in the sinker pattern diagram of FIG. 29, first spaced-apart groups of four sinkers (solid circles) are advanced inwardly during the knitting of alternate courses while second spaced-apart groups of four sinkers (cross hatched circles) are advanced inwardly during the knitting of intervening courses to form vertical stripes of adjacent groups of four pile loops. Thus, during the knitting of the first course of the fabric at the first yarn feeder (FIG. 30), the sinker pattern wheel advances the sinkers associated with the knitting of the four adjacent wales A so that pile loops are formed by placing the first pile loop yarn over the sinkers while the ground yarn is fed beneath the sinker noses. At the same time, the four sinkers associated with the knitting of the wales B are not advanced so that the first pile loop yarn forms plain stitch loops in plated relationship with the ground yarn. During the knitting of the second course of fabric at the second feeder, the sinker pattern wheel advances the sinkers associated with the knitting of the four adjacent wales B so that pile loops are formed by placing the second pile loop yarn over the sinkers while the ground yarn is fed beneath the sinker noses. The sinkers in the wales A are not advanced so that both the pile loop yarn and the ground yarn form plain stitch loops without pile loops. FIG. 31 illustrates the pile loops, knit in accordance with the prior art of FIG. 30, being cut or sheared to provide a velour type of fabric. As shown in FIGS. 30 and 31, the pile loops forming adjacent walewise stripes are not formed in the same course but are formed in alternating courses. Thus, the density of pile loops is one-half of the density of the stitch loops formed of the ground yarn, resulting in a pile or velour patterned fabric having less than the desired density of pile loops.

SUMMARY OF THE INVENTION

In contrast to the above-described type of pile jacquard knit fabric, the knitting methods of the present invention provide a pile jacquard pattern fabric in which each of the pattern pile loop yarns forms corresponding groups of pile loops in a side-by-side manner and in every course to provide a density of pile loops which is the same as the density of ground stitch loops.

Generally, groups of adjacent pile loops are formed of different pile loop yarns in a side-by-side manner and in the same course, in accordance with the knitting methods of the present invention. This is accomplished by feeding the ground yarn to all of the needles, feeding a first pile loop yarn to selected spaced-apart groups of needles raised to tuck level to form pile loops over corresponding advanced sinkers, feeding a second pile loop yarn to the remaining spaced-apart groups of needles raised to tuck level to form pile loops over corresponding advanced sinkers, and then simultaneously knitting the ground yarn along with the first and second pile loop yarns. The portions of the first pile loop yarn between the first groups of pile loops extend as elongate floats above the second groups of pile loops while the portions of the second pile loop yarn between the second groups of pile loops extend as elongate floats above the first groups of pile loops.

In accordance with the present invention, a two-color jacquard pattern fabric can be produced by either a repeated three-feeder knitting procedure or by a repeated two-feeder knitting procedure. In the three-feeder knitting procedure, all needles are raised to latch clearing or knitting level and fed the ground yarn at the first yarn feeder. All needles are then lowered to the welt or float level where the old loops which are about to be cast off are retained on the outside of the closed latch of the needles. At the second yarn feeder, certain groups of adjacent needles remain at this welt level while other groups of adjacent needles are raised to the tuck level and fed a first pile loop yarn. The sinkers associated with these needles ar advanced inwardly beneath the first pile loop yarn. These needles with the first pile loop yarn are then lowered to a level where the top of the needle hook is slightly higher than the surface of the sinker nose so that the first pile loop yarn is positioned above the sinker nose. At the third yarn feeder, the needles which were raised to tuck level at the second feeder remain at the welt level while the needles which remained at the welt level at the second feeder are raised to tuck level and are fed a second pile loop yarn. The sinkers associated with these needles are advanced inwardly beneath the second pile loop yarn. These needles with the second pile loop yarn are then lowered so that the second pile loop yarn is positioned above the sinker nose. The inward movement of the sinkers at the second and third feeders positions the floating portions of both the first and second pile loop yarns on the inside of the needles. All needles then are lowered to stitch drawing level so that the required lengths of the first and second pile loop yarns are drawn over the sinker nose while the ground yarn is drawn over the sinker knitting face. As the old loops are cleared from the needles, the first and second pile loop yarns form corresponding groups of adjacent first and second pile loops in a side-by-side position in this single course of fabric. As this three-feeder sequence is continued, vertical stripes of pile loops are formed.

In a second embodiment, the jacquard pattern fabric is produced by a two-feeder procedure in which the ground yarn is fed to all needles at the first yarn feeder while a first pile loop yarn is also fed to selected groups of adjacent needles and the other needles pass the first yarn feeder at welt or float position and do not receive the first pile yarn therein. The sinkers associated with these needles which pick up the first pile loop yarn are advanced inwardly beneath the first pile loop yarn. The needles are then lowered at the first yarn feeder to a welt level to retain the old loops about to be cast off the needle on the outside of the closed latch of the needles.

At the second yarn feeder, the second pile loop yarn is fed to the remaining needles as they are raised to tuck level while the needles which picked up the first pile loop yarn at the first feeder are maintained at the welt or float level so that they do not pick up the second pile loop yarn. The sinkers associated with the needles selected for picking up the second pile loop yarn are advanced inwardly so that the second pile loop yarn extends above the sinker nose. The inward movement of the sinkers at the second yarn feeder positions the extended floats of the first pile loop yarn on the inside of the corresponding needles. After the second pile loop yarn is fed at the second feeder, all needles are lowered to the knitting or stitch drawing level so that the old loops are cleared from the needles and the pile loops of the first and second pile yarns are formed in a side-by-side position in the same course.

In both the described three-feeder and two-feeder knitting procedures, four wale wide vertical stripes of pile loops are formed of different pile loop yarns in side-by-side position in each course of the fabric. However, it is to be understood that additional feeds can be employed so that more than two separate pile loop yarns may be used to form corresponding pile loops in the same course. Also, the needle selection and sinker operation may be varied to produce various other types of loop pile patterns.

BRIEF DESCRIPTION OF THE DRAWINGS

Other objects and advantages will appear as the description proceeds when taken in connection with the accompanying drawings, in which—

DESCRIPTION OF THE PREFERRED EMBODIMENTS

Figure 1:
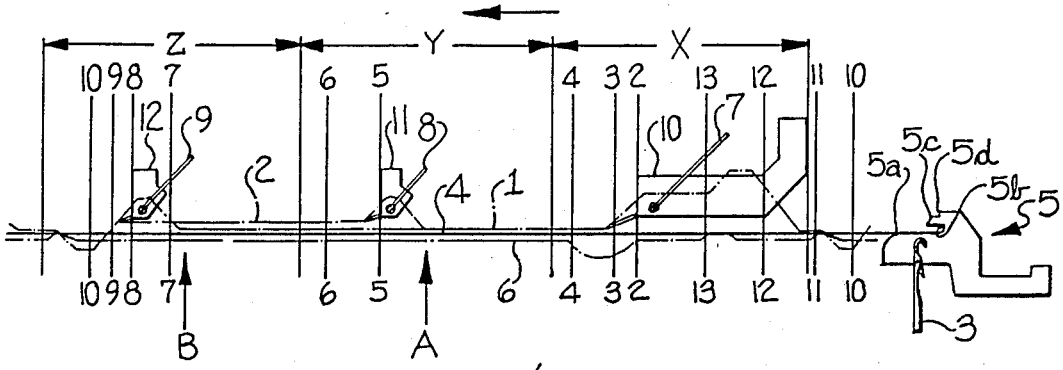
FIG. 1 is a schematic developed view looking outwardly from inside of the needle cylinder and showing the operation of the needles and sinkers at each of the three yarn feeders.
Figure 2A:
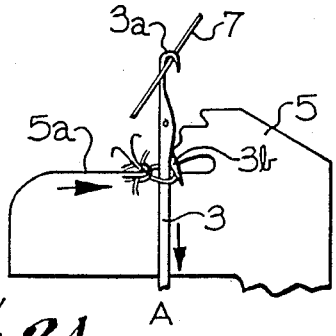
FIGS. 2A through 13B are successive vertical sectional views illustrating the relative positions of the needles and sinkers during a three-feeder knitting procedure, being taken along the respective lines 2—2 through 13—13 of FIG. 1.
Figure 2B:
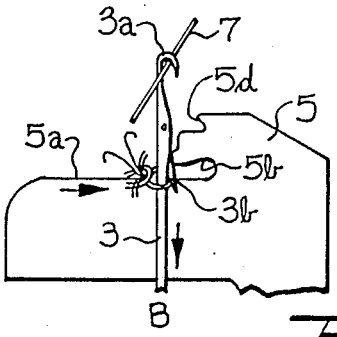
Figure 3A:
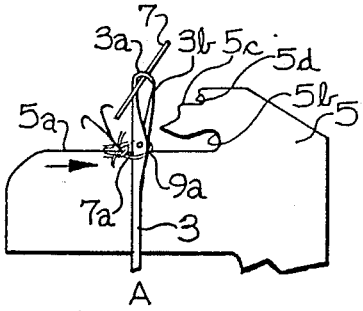
Figure 3B:
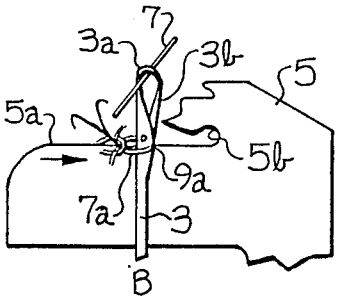

The knitting of the two-color jacquard pattern fabric will be described in connection with FIGS. 1–13B in which a repeated three-feeder knitting procedure is utilized, in accordance with the present invention. After all needles 3 are raised to the latch clearing or highest position, a ground yarn 7 is fed to all needles at the first feeder X by a yarn carrier 10 (FIG. 1). As the needles 3 are lowered, the ground yarn 7 is caught in hooks 3*a* of each of the needles 3, as shown in FIGS. 2A and 2B. At this time, sinkers 5 begin retreating or moving outwardly. As the needles 3 are further lowered, old or previously formed ground needle loop 7*a* and pile needle loop 9*a* slide upwardly on the needle stem 3*c*, as shown in FIGS. 3A and 3B, to raise the latch 3*b* to close the hook 3*a*. The sinkers 5 then retreat or move outwardly to the outermost position, as shown in FIGS. 3A and 3B.

Figure 4A:
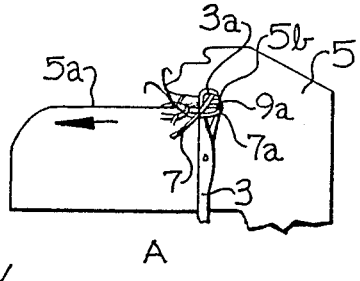
Figure 4B:
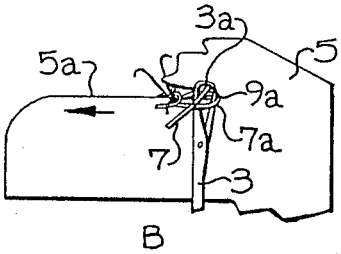
Figure 5A:
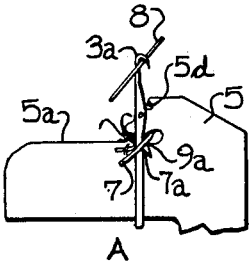
Figure 5B:
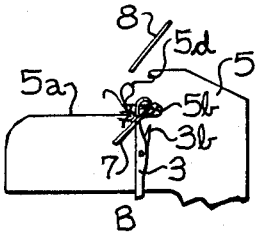

The needles 3 then further move downwardly to the welt position, as shown by the one-dot chain line 1 in FIG. 1. As the needles 3 move down to the welt position, the old loops 7*a* and 9*a* are retained on the outer part of the needle latch 3*b* without being shed or cleared off of the needles, as shown in FIGS. 4A and 4B. The needles 3 then move along the one-dot chain line 1 to the second feeder Y, retaining the old loops on the latches 3*b*. At this time, the sinkers 5 are advanced inwardly and position the ground yarn 7 retained by the lowered needle hook 3*a* in the sinker throat 5*b*.

Figure 6A:
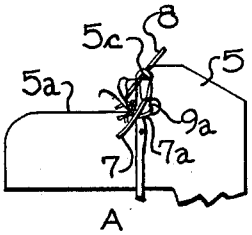
Figure 6B:
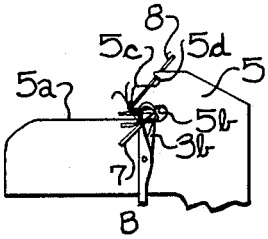
Figure 7A:
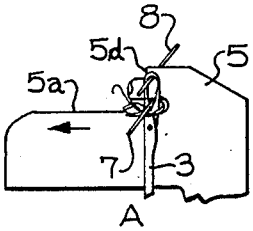
Figure 8A:
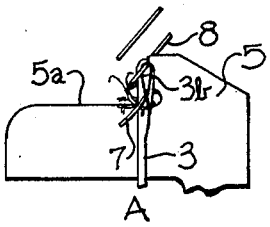

Selection of the needles 3 is then made at needle selection position A to either tuck or welt as they approach the second feeder Y. The needles 3 which have been selected for tuck level at the second feeder Y are raised upwardly and the ground yarn 7 opens the latch 3*b* (FIG. 5A) so that a first pile loop yarn 8 is caught in the needle hook 3*a*. The first pile loop yarn 8 is fed through a yarn feeder 11 (FIG. 1). After these needles have picked up the first pile yarn 8, they are lowered until they reach the one-dot chain line 2 (FIG. 1) with the top of the hook slightly higher than the upper sinker nose face 5*c* (FIG. 6A). Thus, the ground yarn 7 and the pile yarn 8 are in the needle hook 3*a* with the latch 3*b* in a closed position and with the first pile yarn 8 being supported above the upper sinker nose face 5*c* and the ground yarn 7 being supported on the knitting face or surface 5*a* of the sinker, as shown in FIG. 7A. The yarns are supported in this manner until the selected needles reach the third feeder Z, as illustrated in FIG. 8A.

On the other hand, the needles 3 which have not been selected for movement to the tuck level at the first needle selection position A, remain in the welt position and below the level of the first pile yarn 8, as shown in FIGS. 4B through 6B. In this position, these needles 3 at welt position retain the ground yarn 7 in the hooks 3*a* and old loops 7*a* and 9*a* on the outside of the latch 3*b*.

Figure 7B:
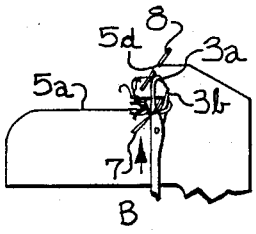
Figure 8B:
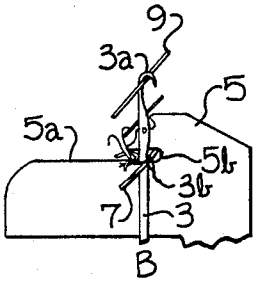
Figure 9A:
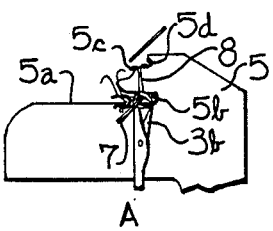

At the third feeder Z, the needles 3 are selected to either tuck or welt at the second needle selection position B. The needles 3 which were selected for tuck level at the first needle selection position A are then selected for welt position at the second needle selection position B and the remaining needles are raised to tuck level, as shown in FIG. 8B. The needles 3 which are not selected remain at the welt level, as shown in FIG. 8A, with the first pile yarn 8 and the ground yarn 7 retained in the closed needle hook 3*a*. Meanwhile, the sinker 5, immediately after being advanced slightly inwardly, as shown in FIG. 7B, is moved outwardly. With further movement, the needle 3 lowers the pile yarn 8 supported by the upper sinker nose face 5c, as shown in FIG. 9A, while the needle is lowered.

Figure 10A:
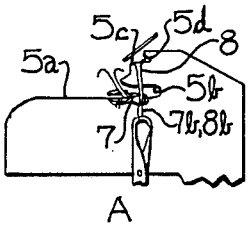
Figure 11A:
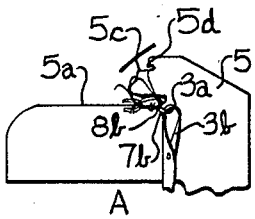
Figure 11B:
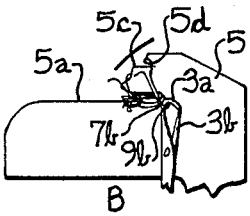

As shown in FIG. 10A, the needles 3 are then moved to the lowest knitting or stitch drawing position so that the old loops 7b, 8b are cleared or shed as stitch loops are drawn with the new pile yarn 8 and the new ground yarn 7 over the upper sinker nose face 5c. The required length of the ground loop yarn 7 and the pile loop yarn 8 is drawn by the sinkers 5. Following the slight raising of the needles 3, the ground needle loop 7b and the pile yarn needle loops are tightened by inward advance of the sinkers 5, as shown in FIGS. 11A and 11B.

Figure 12A:
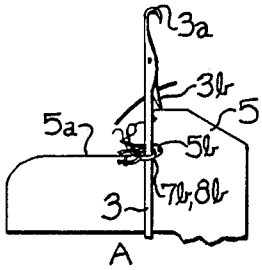
Figure 13A:
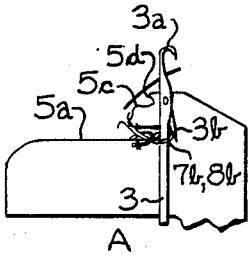

The needles 3 are then moved to the first feeder X and all of the needles 3 are again raised and the ground needle loop 7b and the pile needle loop 8b are retained on the needle and slide downwardly below the latch 3b and onto the needle stem 3c, as shown in FIG. 12A. After the needles 3 arrive at the knitting position as the highest position, they are lowered to tuck level, as shown in FIG. 13A, so that a newly fed ground yarn 7 may be fed to the hook of the needle in the first feeder zone X.

Figure 9B:
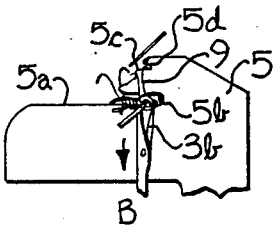

On the other hand, the needle 3 which was selected for welt at the first needle selection position A is selected for tuck level at the second needle selection position B. The needle 3 selected for tuck position is raised slightly, as shown in FIG. 7B, from the position shown in FIG. 6B. The sinker 5 advances slightly inwardly positioning the upper sinker throat 5d at the central portion of the needle hook and turning the floating part of the pile yarn 8 to the inside of the needle. The sinker 5 is immediately returned outwardly and the needle 3, after being raised to the tuck position, catches the pile yarn 9 while descending as shown in FIG. 8B. With further descent of the needle 3, the pile yarn 9 supported by the upper sinker nose face 5c is lowered, as shown in FIG. 9B.

Figure 10B:
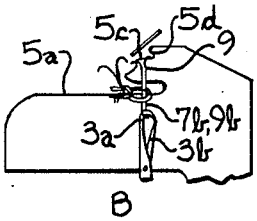
Figure 12B:
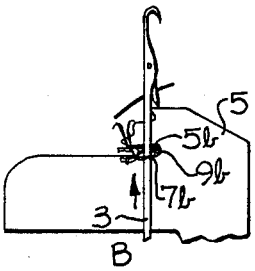
Figure 13B:
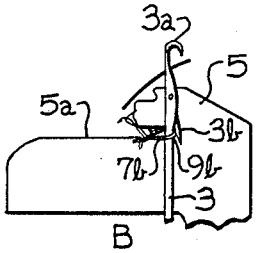

As the needle 3 is moved to the lowest position, as shown in FIG. 10B, the needle 3 is cleared of the old loops and the pile yarn 9 is supported by the upper sinker nose face 5c and the ground yarn 7 is supported by the lower knitting face 5a. Both of these yarns 7 and 9 are lowered together so that the required length of the ground needle loop 7b and the pile needle loop 9b are drawn over the respective faces of the sinker 5. With the slight raising of the needle 3, the sinker 5 advances inwardly, as shown in FIG. 11B to tighten the ground needle loop 7b and the pile needle loop 9b. All needles are again raised at the first yarn feeder X and the ground needle loop B and the pile needle loop 9b are down below the tip of the latch 3b and slide downwardly on the needle stem 3c, as shown in FIG. 12B. After arrival of the needles 3 at the knitting position or the highest shed level, the needle loops 7b, 9b on the needle stem 3c are moved upwardly below the tip of the latch 3b, as shown in FIGS. 13A and 13B, so that a newly fed ground yarn 7 may be fed into the hooks of the needles. This three-feeder knitting procedure is continued to form pile loops of the different pile loop yarns 8, 9 in four adjacent sinker wales. The different pile loop yarns 8 and 9 are continuously knitted in side-by-side relationship in each course formed of the ground yarn 7.

Figure 14:
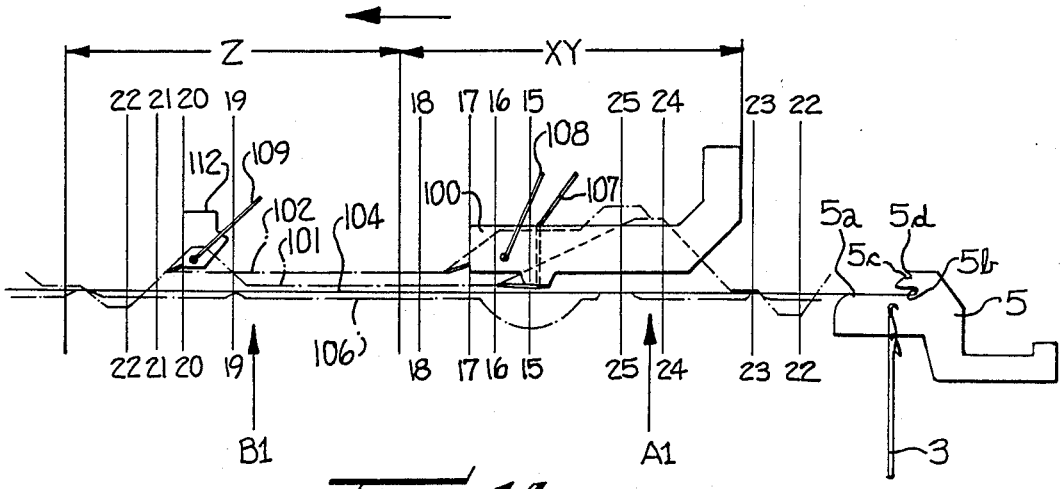
FIG. 14 is a view similar to FIG. 1 but schematically illustrating the two-feeder knitting procedure.

In the second embodiment, the jacquard pattern fabric is produced by a two-feeder procedure in the manner schematically illustrated in FIGS. 14 through 25B. In this second embodiment, both a ground yarn 107 and a first pile loop yarn 108 are fed at a first yarn feeder zone XY by means of a yarn feed finger 100 with the first pile loop yarn 108 being fed at a higher level than the ground yarn 107. A first needle selection mechanism Al is provided at the first yarn feeder zone XY. In FIG. 14, the one-dot chain lines 101, 102 indicate the lines of movement of the top of the hook of the needles 3. A continuous line 104 indicates the top of the knitting faces 5a of the sinkers 5 whereas the two-dot chain line 106 indicates the line of movement of the sinker throats 5b. A second pile yarn 109 is fed through a feed finger 112 at the second yarn feeder zone Z.

Figure 15A:
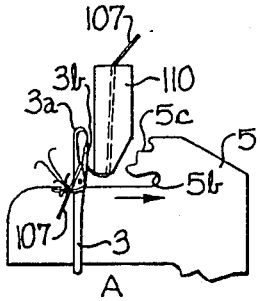
FIGS. 15A through 25B are successive vertical sectional views illustrating the relative positions of the needles and sinkers during a two-feeding knitting procedure, being taken along the respective lines 15—15 through 25—25 of FIG. 14.
Figure 16A:
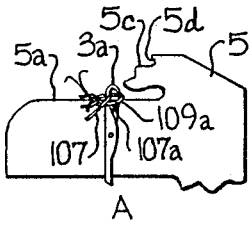
Figure 17A:
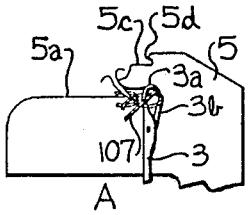

All of the needles 3 are raised to stitch loop clearing level at the first yarn feeder zone XY , as indicated in dotted lines in advance of the yarn feeder 100 in FIG. 14, and certain of the needles are selected to be lowered to the welt position so that they are fed with the ground yarn 107 only, extending outwardly at the bottom of the yarn carrier 100. With the descent of the selected needles, the ground yarn 107 is caught by the needle hook, as illustrated in FIG. 15A. As these selected needles 3 are lowered, the sinker 5 retreats or is moved outwardly further to the outermost position, as shown in FIG. 15A. The selected needles 3 then descend until they reach the welt position, as shown in FIG. 16A, so that the old ground needle loop 107a and the old pile needle loop 109a slide upwardly on the needle stem to raise the latch 3b, thereby closing the hook 3a, as shown in FIG. 16A. The old loops 107a, 109a are not cleared from the needle and are retained on the outside of the closed latch 3b, as shown in FIG. 16A. The needles 3 are then moved to the second feeder Z, remaining at the welt position. The sinkers 5, having retreated to the outermost position, advance inwardly, as shown in FIG. 17A.

Figure 15B:
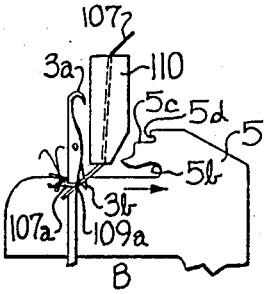
Figure 16B:
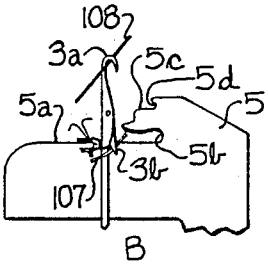
Figure 17B:
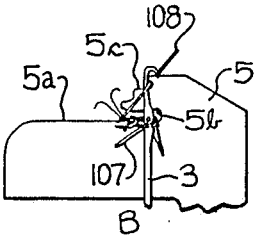
Figure 18A:
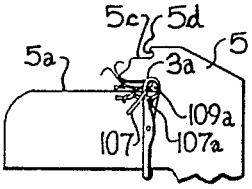
Figure 18B:
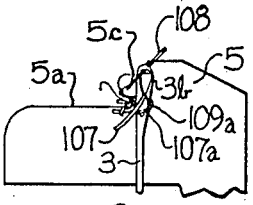

The needles 3 having been selected for picking up the pile loop yarn 108 at the first needle selection position Al have been raised so that the old loops 107a, 109a are moved below the latch 3b, as shown in FIG. 16B. These needles are fed with both the ground yarn 107 and the first pile yarn 108 in the hook of the needle 3 while the needles are being lowered, as shown in FIGS. 15B and 16B. With further descent of the needles 3, the pile loop yarn 108 and the ground yarn 107 are both caught in the hook of the needles, as shown in FIG. 17B. At this time, the sinkers 5 having retreated to the outermost position, are advanced inwardly so that the pile yarn 108 is drawn over the upper sinker noses 5c. The needles 3 are further lowered to the level at which the top of the hook is slightly higher than the upper sinker nose 5c, as shown in FIG. 18B. The ground yarn 107 and the pile loop yarn 108 are then retained by the needle hook with the latch 3b raised by the old loops 107a, 109a. Thus, the pile loop yarn 108 is supported by the upper sinker nose 5c and, staying in that manner, is shifted to the second yarn feeder zone Z.

Figure 19A:
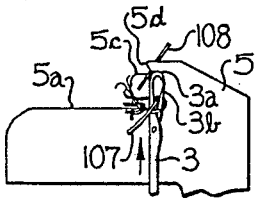
Figure 20A:
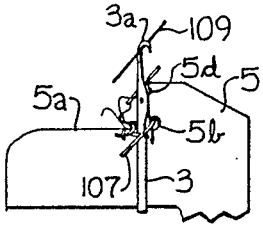
Figure 21A:
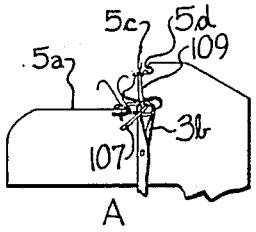
Figure 22A:
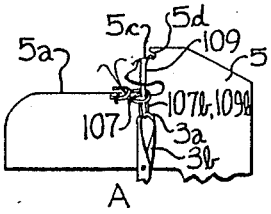

The needle selection of tuck or welt is performed by the second needle selection mechanism Bl in the second yarn feeder zone Z. The needles 3 having been selected for welt at the first needle selection position Al are selected for tuck at the second needle selection mechanism Bl, as shown by the one-dot chain line 101. These needles are moved to the second needle selection position Bl keeping the old loops 107a, 109b retained on the closed latch and then begin raising upwardly from this position, as shown in FIG. 19A. At this time, the sinkers 5 advance slightly inwardly, moving the floating part of the pile loop yarn 108 inwardly inside of the needle hooks and positioning the upper sinker throat 5d in the central space of the needle hook. The needles 3, after being raised to the tuck position, catch the second pile yarn 109, as shown in FIG. 20A, while the needles are being lowered. The pile yarn 109 supported by the upper sinker nose face 5c is drawn downwardly, as shown in FIG. 21A. With further descent of the needles 3, the old loops are cleared or cast off with the needles 3 guided to the lowest position, as shown in FIG. 22A, so that the pile loop yarn 109 and the ground yarn 107, supported by the respective knitting faces 5c and 5a, are drawn downwardly to provide a ground needle loop 107b and pile needle loop 109b which include the required length of yarn.

Figure 23A:
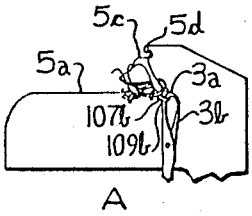
Figure 24A:
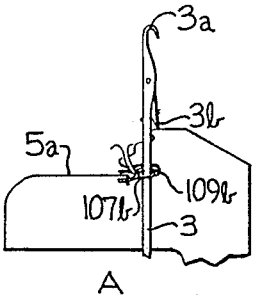
Figure 24B:
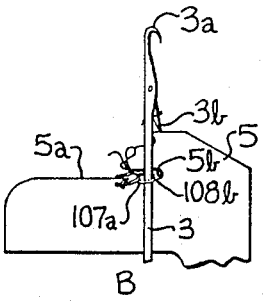
Figure 25A:
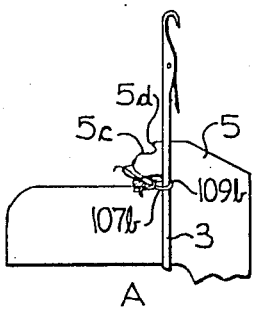
Figure 25B:
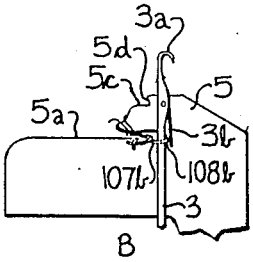

As the needles 3 are slightly raised, the sinkers 5 advance inwardly, as shown in FIG. 23A, so that the ground needle loop 107b and the pile needle loop 109b are tightened on the needle 3. The needle 3 is again shifted to the first feeder XY and all needles are again raised (FIGS. 24A and 24B). With the raising of the needles 3, the ground needle loop 107b and the pile needle loop 109b in the needle hook are cast off of the lower tip of the latch 3b and slide down the needle stem 3c as they are moved to the first needle selection position Al.

Figure 19B:
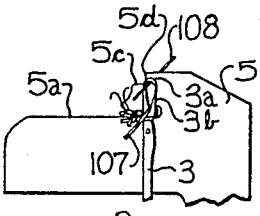
Figure 20B:
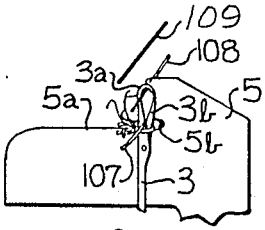
Figure 21B:
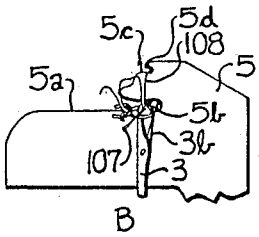
Figure 22B:
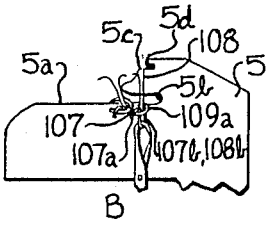
Figure 23B:
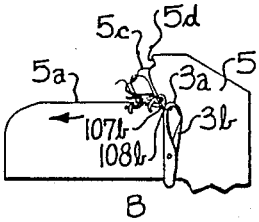

The needles 3 which were selected for picking up the pile yarn 108 at the first feeder XY are then selected for being raised to the welt position at the second needle selection mechanism Bl to produce a state in which the ground yarn 107 and the pile yarn 108 are retained by the needle hook as the needle 3 is moved while maintaining this state, as shown in FIG. 19B and FIG. 20B. As shown in FIG. 21B, the needles 3 draw the pile yarn 108 downwardly, supported by the upper sinker nose face 5c. When the needles 3 are guided to the lowest position, as shown in FIG. 22B, the old pile loops 109a and the ground yarn loops 107a are cleared therefrom so that the pile yarn 108 is supported by the upper sinker nose face 5c, as well as the ground yarn 107 supported by the knitting face 5a, is drawn downwardly to draw the required length of ground needle loop 107b and pile needle loop 108b. With the slight raising of the needles 3, as shown in FIG. 23B, the inward advance of the sinkers 5 tightens the ground loop 107b and the pile needle loop 108b. The needles 3 are again moved to the first feeder XY and all needles are raised. The needles 3 having been raised and cleared of the ground needle loop 107b and the pile needle loop 108b, because of the casting off of these loops from the tip of the latch 3b and downwardly sliding thereon on the needle stem 3c, are moved to the first needle selection position Al. Again, needle selection of pile or welt is performed at the first needle selection position Al.

By this knitting procedure, loops of pile loop yarns 108 and loops of pile loop yarns 109 are formed to be continuous and in a side-by-side manner in each course, and as this pattern is repeated, the pile fabric is produced. The knitting procedures, as referred to in the first and second embodiments described above, can be carried out on various types of circular knitting machines, such as model FX-SDP, presently manufactured and sold by Precision Fukuhara Works Ltd. It is to be understood that the knitting methods described above can be varied. For example, in the first embodiment, an increased number of additional second yarn feeders Y may be provided in which tuck or welt needle selection is performed at the additional yarn feeders. Also, in the second embodiment, an increased number of second feeders Z in which tuck or welt needle selection is performed may be provided to enable knitting of a pile jacquard knit fabric having courses each being in three or four colors, rather than in two colors, so that a pile jacquard knit fabric of increased pattern possibilities can be obtained.

Figure 26:
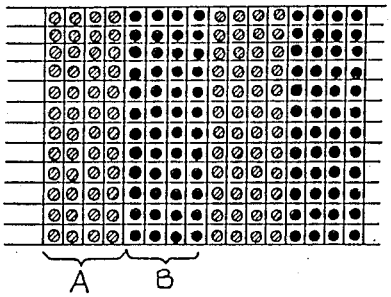
FIG. 26 is a sinker pattern diagram illustrating the manner in which the sinkers are advanced during the knitting of each course in the knitting of a two-color pile jacquard pattern fabric in accordance with the present invention.
Figure 27:
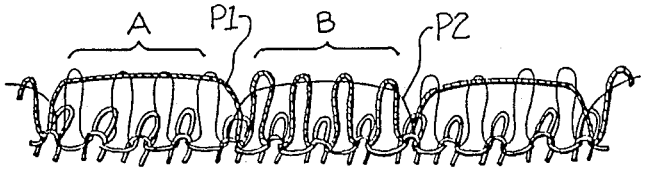
FIG. 27 is a perspective view of one course of the present two-color pile jacquard pattern fabric.
Figure 28:
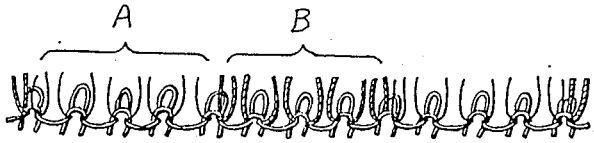
FIG. 28 is a view similar to FIG. 27 but showing the pile loops being cut or sheared.
Figure 29:
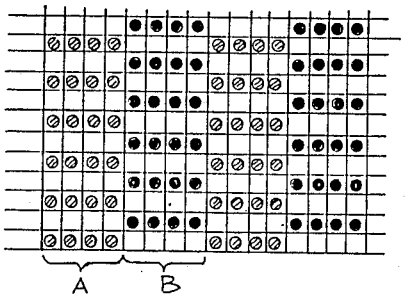
Fig-29 (PRIOR ART)
FIG. 29 is a sinker pattern diagram illustrating the manner in which the sinkers are operated in alternate courses in the knitting of the prior art type of jacquard knit pattern fabric.
Figure 30:
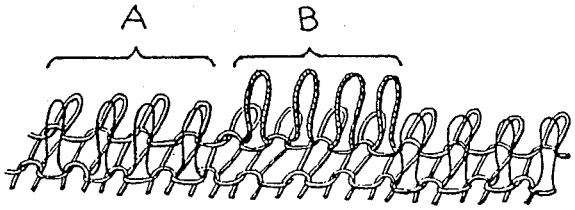
Fig-30 (PRIOR ART)
FIG. 30 is a perspective view of a pair of adjacent courses, illustrating the manner in which the pile loops are formed in successive courses in the knitting of the prior art type of two-color pile jacquard pattern fabric.
Figure 31:
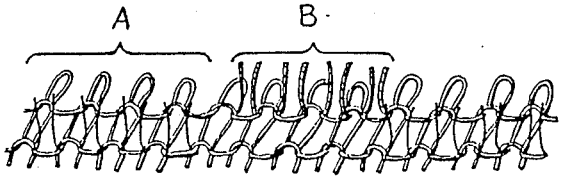
Fig-31 (PRIOR ART)
FIG. 31 is a view similar to FIG. 30 but illustrating the pile loops being cut or sheared.

In each of the described embodiments, the sinkers may be arranged, as shown in FIG. 26, to produce four wale wide vertical stripes in a two-color pile jacquard pattern fabric. One group A of four sinkers is indicated in the area marked with cross hatched circles and the other group B of four sinkers is indicated in the areas marked with solid circles. In this manner, one pile yarn, illustrated by the striped yarn Pl, forms individual pile loops in the sinker wales B and an elongate float in the sinker wales A while the other pile yarn P2 forms individual pile loops in the sinker wales A while forming an elongate float above the pile loops in the sinker wales B. As will be noted in FIG. 27, both the individual pile loops and the elongated floats of both pile yarns Bl and P2 are formed in a single course with the ground yarn and in side-by-side relationship so that the number of pile loops in the coursewise direction is equal to the number of ground loops in each course. When both of the groups of pile loops and pile yarn floats are cut or sheared, as illustrated in FIG. 28, a velour type of jacquard pattern fabric of thicker density is obtained than can be obtained with the conventional prior art method, as illustrated in FIGS. 29–31.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A method of knitting a pile jacquard fabric on a circular knitting machine including needles and a single piece sinker positioned between each pair of said needles, and a plurality of groups of two adjacent yarn feeders, said pile jacquard fabric including successive courses of plain jersey stitch wales knit of a ground yarn, each successive course also including a first pile loop yarn knit with the ground yarn in selected groups of adjacent needle wales and forming an individual pile loop in each intervening sinker wale, a second pile loop yarn knit with the ground yarn in other groups of adjacent needle wales and forming an individual pile loop in each intervening sinker wale, multiwale floats on the first pile loop yarn extending above the individual pile loops in the sinker wales of the corresponding selected groups of adjacent needle wales, and multi-wale floats of the second pile loop yarn extending above the individual pile loops in the sinker wales of the corresponding other groups of adjacent needle wales, and wherein the upstanding individual pile loops and the multi-wale floats are adapted to be cut in a shearing operation to form a patterned velour jacquard fabric, said method including the sequential steps of raising all of the needles to stitch loop clearing level and feeding ground yarn into the hooks at the first yarn feeder of each group while the sinkers are retracted;

lowering first groups of needles to welt level while receiving the ground yarn;

raising second selected groups of needles and feeding the first pile loop yarn in the hooks of said second groups of needles and above inwardly advanced sinkers at the first yarn feeder, while floating the first pile loop yarn inside of said first groups of needles;

raising said first groups of needles from said welt level and feeding the second pile loop yarn in the hooks thereof and above inwardly advanced sinkers at the second yarn feeder, while floating the second pile loop yarn inside of the second groups of needles; and lowering all of the needles to knitting level at the second yarn feeder to form a course of plain jersey stitches of the ground yarn with individual pile loops of the first pile yarn extending upwardly from intervening sinker wales corresponding with the selected groups of adjacent needle wales and with individual pile loops of the second pile yarn extending upwardly from intervening sinker wales corresponding with the other groups of adjacent needle wales, both the individual pile loops of the first and second pile loop yarns being positioned in side-by-side relationship in adjacent groups in one continuous ground yarn course.

* * * * *